United States Patent [19]

Weaver

[11] Patent Number: 4,659,340

[45] Date of Patent: Apr. 21, 1987

[54] PRESSURIZED DOWNDRAFT GASIFIER

[76] Inventor: Lloyd E. Weaver, 14 Home Pl., Topsham, Me. 04086

[21] Appl. No.: 748,325

[22] Filed: Jun. 24, 1985

[51] Int. Cl.[4] ..... C10J 3/20; C10J 3/32; C10J 3/42

[52] U.S. Cl. ..... 48/76; 48/68; 48/85.2; 48/111; 110/229; 165/94; 165/95

[58] Field of Search ..... 48/62 R, 76, 77, 66–68, 48/85.2, 87, 111; 110/229, 247, 251, 258, 259, 165 R, 170, 171; 165/94, 95, 169; 122/5, 6 A, 235 N, 387; 422/198

[56] References Cited

U.S. PATENT DOCUMENTS

| | | | |
|---|---|---|---|
| 1,375,210 | 4/1921 | Clayton et al. | 165/94 |
| 2,381,200 | 8/1945 | Blake | 110/165 R |
| 2,689,786 | 9/1954 | Hubmann | 48/66 |
| 3,847,562 | 11/1974 | Hamilton | 48/87 |
| 3,881,885 | 5/1975 | Wagner | 48/76 |
| 4,014,664 | 3/1977 | Kupfer et al. | 48/68 |
| 4,279,295 | 7/1981 | Duckworth | 165/94 |
| 4,344,772 | 8/1982 | Pillard | 48/76 |

OTHER PUBLICATIONS

Solar Energy Research Institute, "Low-BTU Gasification: An Introduction", Oct. 1980, SERI/SP-733-832, pp. 1-12.

*Primary Examiner*—Barry S. Richman
*Assistant Examiner*—Joye L. Woodard
*Attorney, Agent, or Firm*—Laforest S. Saulsbury

[57] ABSTRACT

A pressurized downdraft gasifier for extracting high quality burning gases from fuels with low rates of gasification. The downdraft air with the gas products is made to take a tranverse path through a cylindrical bar grate depending into the ash collecting chamber from a throated bottom structure of the gasifying chamber and into annular space surrounding the grate at the top of the ash chamber from which space the gas products are delivered to gas burners and turbines to be utilized. Grate clearing assemblies are supported by their three blades respectively overlying respective grate bars and have a loose splined drive connection with a vertical drive shaft to allow the assemblies to tilt or rock while adjusting to clinkers plugging the grate bars. In the bottom of the ash chamber is a hearth plate with a central opening and a rejection plate also similarly loosely connected to the same vertical drive shaft to adjust to clinkers when sweeping the ash into the central opening of the hearth plate. A hollow inner drive shaft extends upwardly through the outer drive shaft, that drives grate clearing and hearth sweeping assemblies, to deliver cooling air to the shafts and to a rotary leveler mounted on its upper end that levels the fresh fuel being admitted to the gasifying chamber and at the same time supplies further air pressure to the gasifying chamber from the leveler. Level controllers are respectively provided in the respective gasifying and ash-receiving chambers and operable in response to the level of their contents to supply fuel to the gasifying chamber and to discharge the ash from the ash chambers.

11 Claims, 5 Drawing Figures

PRESSURIZED DOWNDRAFT GASIFIER

FIELD OF THE INVENTION

This invention relates to a pressurized downdraft gasifier for extracting high quality burning gases from fuels with low rates of gasification.

SUMMARY OF THE INVENTION

It is the principal object of the present invention to provide a pressurized downdraft gasifier adapted for use with fuel having low rates of gasification, such as wood chips, garbage and trash, that will generate higher temperatures than temperatures generated within conventional gasifiers and in which the quantity of the contents of developed gases will be increased and have high quality.

It is another object of the invention to provide a pressurized downdraft gasifier in which the developed gases will be passed laterally or travsversely and angled from their normal downward path and through a cylindrical grate that laterally confines the clinkers and ash well within the ash chamber.

It is still another object of the invention to provide a pressurized downdraft gasifier that employs a vertically-extending cylindrical grate with a suitable rotary cylindrical grate bladed clearing assembly having laterally-extended blades respectively operable over respective individual circular grate bars for clearing the grate of clinkers and directing the ash toward the open bottom hearth of the depending ash chamber.

It is still another object of the invention to provide a pressurized downdraft gasifier having cylindrical grate blade clearing assemblies and an open bottom hearth with a radial helical-edged rotary clearing plate for sweeping the ash over the open hearth plate and through its central opening to direct the final ash into an ash pit for removal from the gasifier and a common central splined drive shaft with which loose fitting female spline drive connections of the grate clearing blade assemblies and of the open hearth clearing plates are made therewith to tiltably adjust or overrun the severe clinker obstructions of the grate and hearth.

It is still another object of the invention to provide a pressurized downdraft gasifier with a common drive shaft means for driving cylindrical grate bar clearing assemblies and open hearth ash rejection plate including an outer hollow rotary drive shaft and an inner hollow rotary drive shaft extending upwardly through the outer drive shaft and into the fresh fuel mass in the gasifying chamber with an air-cooled transverse rotary leveler on its upper end for leveling the fuel mass in the gasifying chamber and supplying the air thereto for combustion, and a throat plate also carried by the inner shaft and lying within the bottom throat zone of the gasifying chamber, all to be rotated within the gasifying chamber to activate the fresh fuel mass and to add cooling air to the fuel mass through the drive shafts and fresh fuel leveler to cool the same and at the same time supply further air under pressure to the gasifying chamber.

It is a further object of the invention to provide a pressurized downdraft gasifier in which fresh fuel is delivered in measured amounts to a gasifying chamber that has a fuel leveler therein and a restricted high temperature throat area, an ash accumulation chamber lying below the gasifying chamber and vertically-grated for transvers delivery of generated gases to an annular space thereabout from which clean gas products from the gasifier are discharged, an open hearth plate on which the final ash is collected for delivery through its central opening to an ash pit by an ash sweeping plate and level responsive devices respectively extending into the respective gasifying, ash collection and ash pit chambers to level the contents of fresh fuel and ash chamber to maintain their level therein and to dispense the ash over the hearth plate into its central opening to ash pit and from the ash pit chamber all upon reaching pre-determined levels of fresh fuel and ash within the gasifier.

Still further objects of the invention are to provide a pressurized downdraft gasifier, having the above objects in mind, which is of simple construction, easily installed, consumes little space, ensures continuous flow of fuel material and ash, economical to operate, automatic, exceedingly effective and efficient in operation.

BRIEF DESCRIPTION OF THE DRAWINGS

For a better understanding of the invention, reference may be had to the following detailed description taken in connection with accompanying drawing, in which.

DESCRIPTION OF THE PREFERRED EMBODIMENTS

Figure 1:
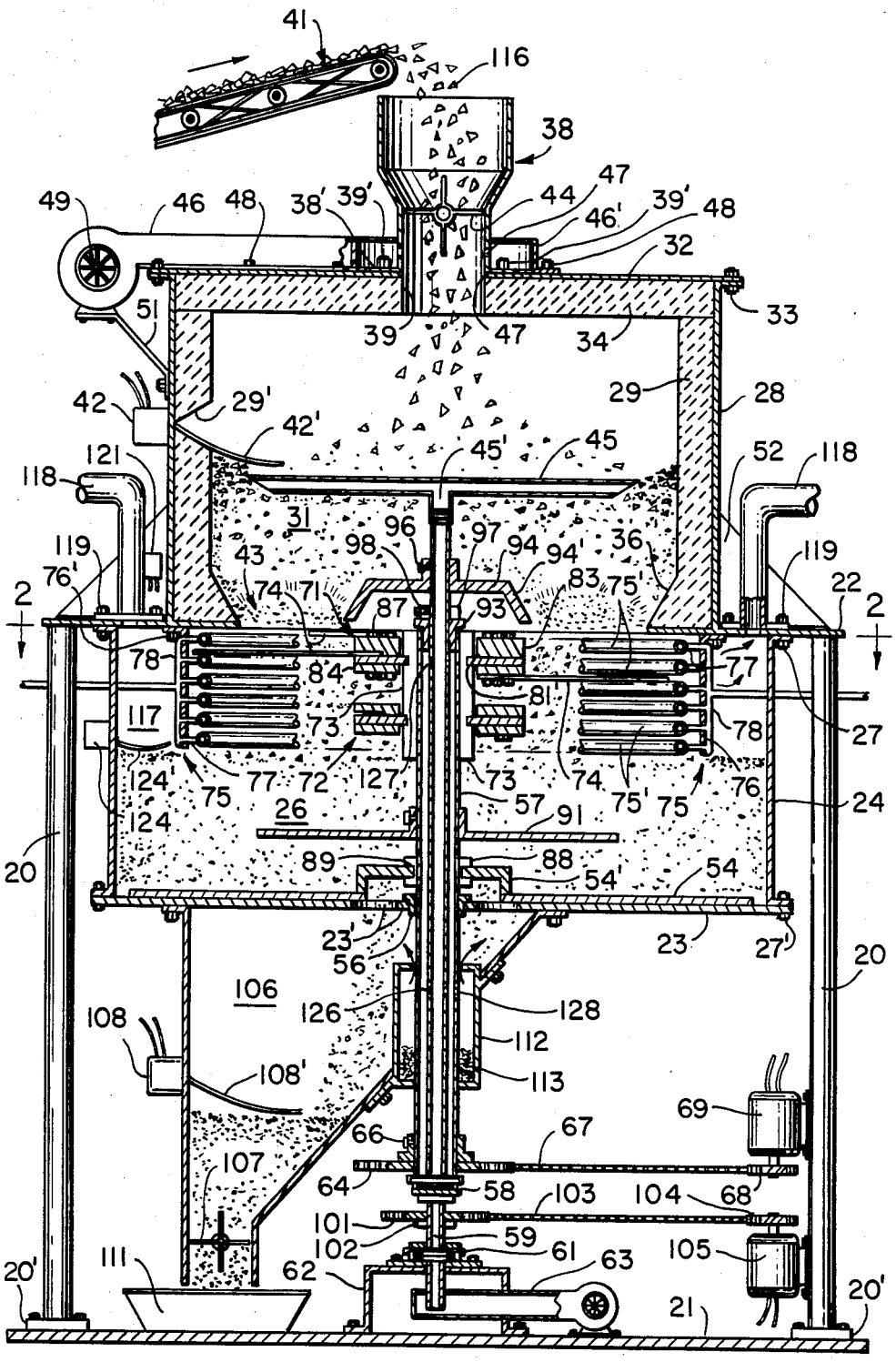
FIG. 1 is a vertical sectional view of the pressurized downdraft gasifier embodying the features of the present invention including a cylindrical grate and open hearth with double hollow shaft drive and air delivery means for driving hellically-bladed grate bar clearing assemblies, hearth clearing plate, throat plate ash capping plate and the air-cooled fresh fuel leveler.

Referring now to the Figures, 20 represents main support posts, but two of which being shown in FIG. 1, four in all, equally angularly-spaced from one another and with their flanged feet 20' secured to a metal base plate 21. The upper ends of the support posts 20 are welded to the underside of a wide annular plate 22 near to its outer periphery to provide an enlarged space for housing a bottom open ash hearth plate 23 carried by a cylindrical wall 24 depending from the underside of the annular plate 22 inwardly of the support posts 22 and providing an ash-receiving or collection chamber 26. This cylindrical wall 24 is detachably secured to the annular plate 22 by bolts 27 and to the hearth plate 23 by bolts 27'.

Extending upwardly from the annular plate 22 inwardly of the ash chamber wall 24 and concentric therewith, is a metal cylindrical wall 28 lined with refractory material 29 to provide a gasifying chamber 31 into which wood chips, garbage or other low gasification material is poured. The lower end of the cylindrical wall 28 is integrally welded to the annular plate 22, while the upper end of the cylindrical wall 28 is outwardly flanged to receive a top closure plate 32 that is detachably secured by bolts 33 to the wall. This closure plate 32 has refractory material 34 that joins with the wall refractory 29 to fully line the gasifying chamber 31 so as to withstand high burning temperatures of the fuel mass therein. Level sensor arm 42' of sensor 42 constantly moves up and down in a vertical plane periodically touching the fresh fuel mass. As the level of the mass falls due to its gasification and through the incandescent or throat zone 42 of the gasifying chamber 31 the level arm 42' will drop and fresh fuel will be added to the chamber 31.

A rotary air lock feeder 44 is journaled between vertical side walls of a funnel-shaped structure 38 and driven by an electric motor, not shown, and interconnected by wiring in any suitable manner to level sensor 42 and the fuel feeder drive 44 operable in response thereto.

The lower end of the wall refractory 29 is funneled or internally tapered at 36 to provide a bottom annular throat formation through which gasifying chips will be lowered and finally burned. The annular plate 22 extends inwardly of the cylindrical wall 24 to support the enlarged annular throat formation 36 of the refractory lining material 29 of the gasifying chamber wall 28.

The refractory-lined closure plate 32 has a central opening 39 over which air lock fresh fuel feed funnel structure 38 is secured to this plate by its bottom flange 38' and bolts 38. The top of the funnel 38 is open to receive wood chips dropped thereinto from an overlying fresh fuel feed belt conveyor 41 operable in response to fuel level sensor arm 42' lying above rotary air-cooled leveler 45 thereby to maintain the level of the fuel mass in the gasifying chamber 31. This fresh fuel addition operation may be effected by a standard motor drive for the feed belt conveyor 41 and any suitable wiring with an electric source therefor. The wall refractory material 29 is cut away at 29' to permit the free vertical movement of the sensor arm 42'.

Extending across the top closure plate 32 is a motor driven downdraft air supplying conduit 46 with a plenum-shaped end 46' surrounding the funnel 38 for delivery of low pressure high volume combustion air by way of side openings 47 to the gasifying chamber 31. This air supplying conduit 46 is secured to the top plate 32 by bolts 48 passing through its bottom flange. The downdraft air supply conduit 46 includes a motor-driven fan 49 supported on a bracket 51 on the cylindrical chamber wall 28. The motor-driven fan 49 will be driven constantly at a selected speed to provide a continuous large volume flow of downdraft air to the fuel gasifying chamber 31.

The cylindrical chamber wall 28 is braced upon the annular plate 22 by vertically-extending gusset plates 52 angularly-spaced from one another thereabout and welded by their edges to the annular plate 22 and cylindrical wall 28.

Figure 4:
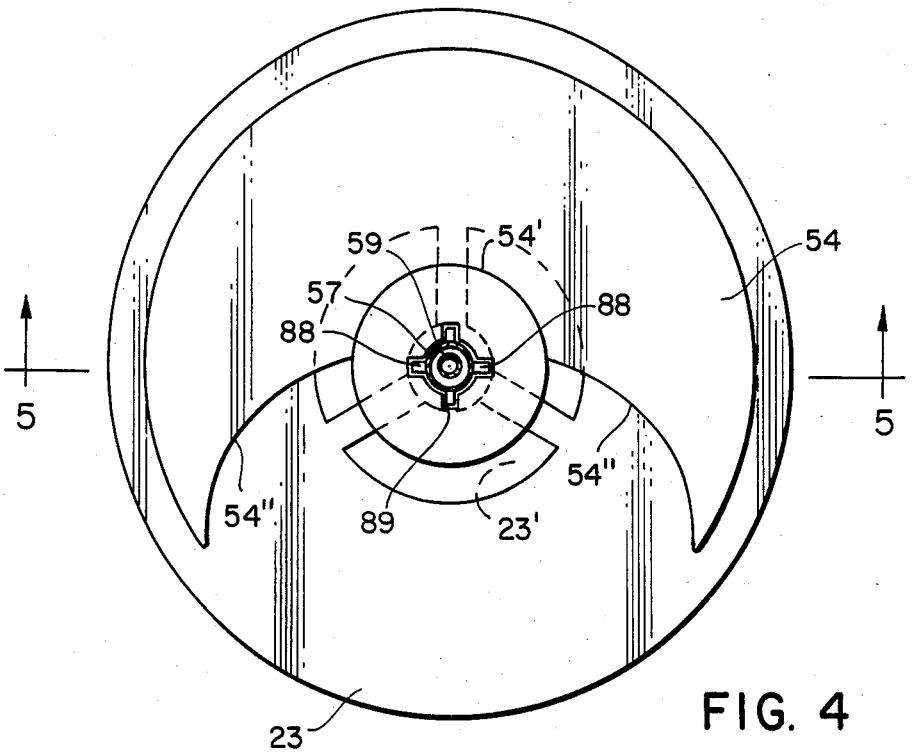
FIG. 4 is a transverse sectional view taken on line 4—4 of FIG. 1 and looking down in plan upon the ash hearth clearing plate for sweeping ash through the central spider arm opening of the hearth plate.
Figure 5:
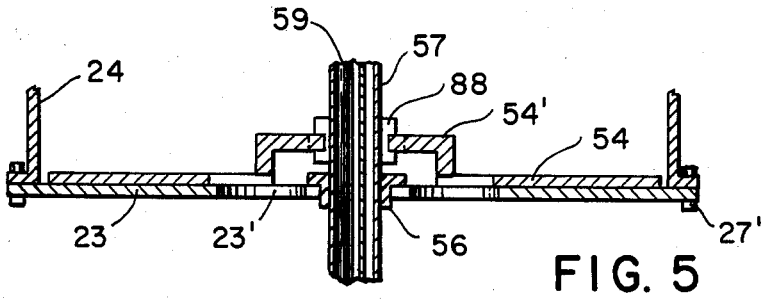
FIG. 5 is a vertical sectional view of the ash hearth-sweeping rejection plate as viewed on line 5—5 of FIG. 4.

The ash hearth plate 23 has a central spider arm opening 23' into which ash is swept by a rotary semi-disc hearth clearing member 54, FIGS. 1, 4 and 5, with inwardly helically-curved sweepings edges 54 to engage and draw the ash radially inwardly for discharge through hearth plate spider opening 23'. This hearth plate spider arm opening formation 23' carries a flanged sleeve bushing 56.

Extending upwardly through the bushing 56 is a vertically-extending outer hollow drive shaft 57 by which the hearth clearing member 54 is driven in a manner to be later described. This outer drive shaft 57 is supported at its lower end by a thrust bearing connection 58 to an inner vertically-extending hollow drive shaft 59, that is, in turn, supported by a bottom thrust bearing 61 box structure 62 and the open end of inner drive shaft 59 depends into the box structure 62 upon the gasifier base plate 21. A fan operated device 63 also on base plate 21 extends into the box structure 62 to deliver cooling air under pressure to lower open end of the inner hollow drive shaft 59.

On the lower end of the outer drive shaft 57, is a chain sprocket 64 fixed thereto by set screw 66. A drive chain 67 laterally connects sprocket 64 with a drive sprocket 68 of an electric motor 69 carried on a gasifier support post 20. By this chain and sprocket assembly, the outer drive shaft 57 is driven to rotate identical upper and lower helical-bladed grate clearing assemblies 71 and 72 and the ash hearth semi-disc clearing member 54, all in a manner to be described in detail.

Just below the upper end of the outer drive shaft 57, there are welded four equally angularly-spaced splines 73 about which the grate clearing assemblies 71 and 72 are assembled and supported by ends of their three helical-shaped blades 74 respectively overlying respective different level circular hollow grate bars 75' of a cylindrical grate bar assembly 75 depending into ash chamber 26 from the underside of annular plate 22.

Figure 2:
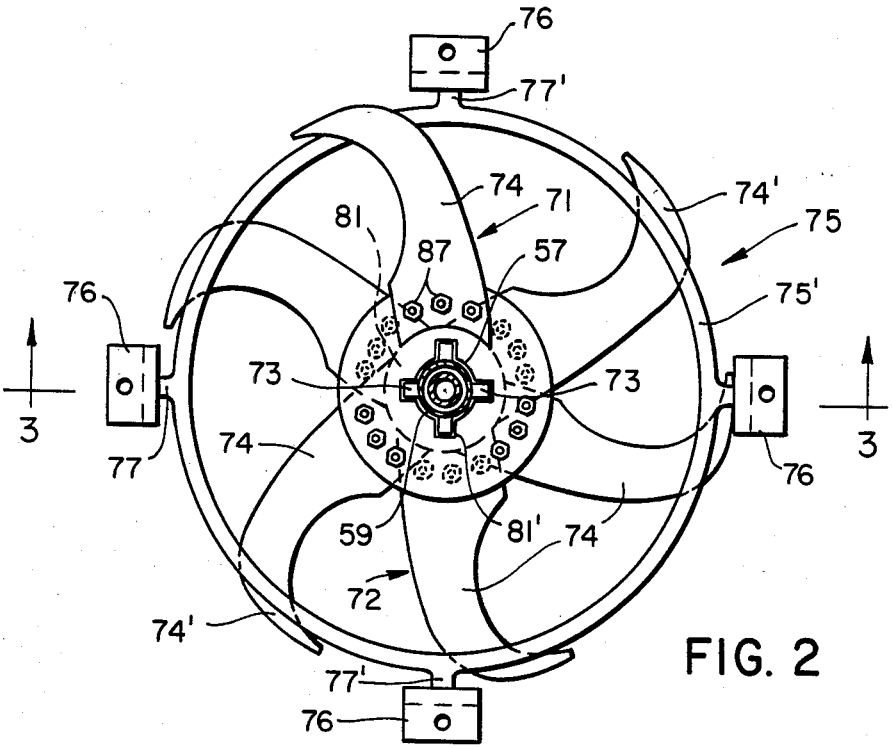
FIG. 2 is a transverse sectional view taken on line 2—2 of FIG. 1 and looking down in plan upon the helically-bladed cylindrical grate bar clearing assemblies that clear the cylindrical grate of clinkers and ash.
Figure 3:
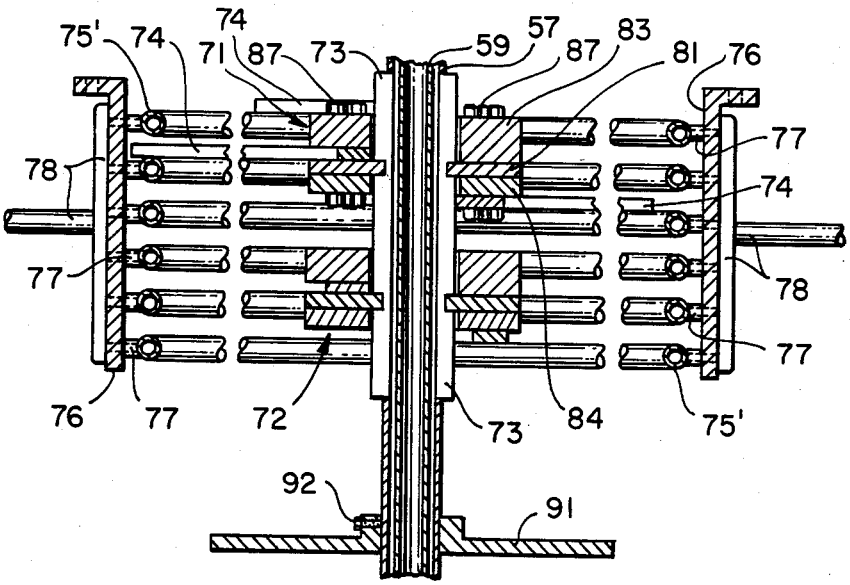
FIG. 3 is an enlarged vertical sectional view of the helical-bladed cylindrical grate bar clinker clearing assemblies taken generally on line 3—3 of FIG. 2.

The circular bars 75' are welded one above the other to vertically-extending hanger members 76 angularly-spaced thereabout to secure the cylindrical grate bar assembly 75 to the annular plate 22 by bolts 76'. As best seen in FIG. 3, the grate bars 75' are hollow and connected to the hangers 76 by short pipes 77 and through holes in hangers 76 that communicate with water manifolds 78. Cooling water will be delivered to one of the manifolds 78 at one side and discharged from another manifold at the opposite side of the cylindrical grate assembly 75. The other two hangers 76 have the circular grate bars connected by non-pipe short pieces 77', FIG. 2.

The ash hearth semi-disc clearing member 54 is also similarly loosely splined to the outer vertically-extending drive shaft 57, so that it can tiltably adjust and ride over any real clinker obstruction upon the open hearth plate 23. Four equally angularly-spaced splines 88 are welded to the outer drive shaft 57 that are loosely received in oversize notches 89 in a raised hub portion 54' on the semi-disc clearing member 54, FIG. 5. Thus, not only can the semi-disc clearing member 54 be elevated upon the outer shaft 57, but can be tilted to left over any molten obstruction that may have adhered to the hearth plate surface.

The raised hub portion 54' of the semi-disc clearing member 54 overlies the sleeve bushing 56 carried by the hearth plate 23. The semi-disc clearing member 54 is of substantial thickness and normally lies flush upon the hearth plate 23. Its helically-cut sweeping edge 54" drags the ash over the hearth plate 23 and directs the ash into the central spider opening formation 23' within the hearth plate 23.

A rotary circular cap plate 91 is secured to the outer drive shaft 57 by a set screw 92 just above the semi-disc clearing member 54 and the ash hearth plate central opening 53 to prevent the ash from freely falling through hearth opening 23 unless made to do so by the clearing member 54.

Since each of the grate bar clearing assemblies 71 and 72 are of the same construction, a description of but one of them should suffice. Reference will thus be made to the upper assembly 71. This grate clearing assembly 71 has an annular female spline-receiving plate 81 that is inwardly notched in four places as at 81' to loosely receive the four splines 73 upon the drive shaft, FIGS. 1, 2 and 3. Stacked above and below the notched splined-receiving plate 81 are spacing rings 83 and 84 to which are secured the three laterally-extending angularly-staggered helically-shaped blades 74 having their tip ends 74' overlying the grate bars 75' for three-point support of the assembly about this splined shaft 57 vertically-free and tiltable thereon but yet adapted to be driven by the splined shaft 57. The spacing rings 83, 84 and blades 74 lie free about the splines of the drive shaft 57 to allow the grate bar clearing assembly to tilt upon the drive shaft 57 while being driven thereby. The notched plate, spacing rings and blades are held together in one rigid assembly by through bolts 87, there being sets of three, one set for each of three blades 74'. The blades 74 are vertically-spaced so that they overlie different level grate bars 75' and are angularly staggered with respect to one another and to the notched splined plate 81.

Since the assembly 71 is loose and relatively free upon the drive shaft 57 by three-point support of the blade ends with the grate bars 75', the assembly will adjust to molten clinker obstructions adhered between the circular grate bars and either free the clinkers or slide over them and thereby lessen possible breakage of the blade assembly or its drive. It should be now understood that the lower grate clearing assembly 72 is of the same construction and will similarly operate over the three lower grate bars 75'.

The hollow inner drive shaft 59 extends upwardly through a sleeve bushing 93 in the upper end of the outer drive shaft 57 and into the fuel mass of the gasifying chamber 31 wherein the fresh fuel mass leveler 45 is T-fitted at 45' to its upper end to be driven thereby. At the same time, air under pressure is fed into the inner hollow drive shaft 59 and is discharged through angular cut ends of the rotary leveler 45 down into the burning mass. The inner drive shaft 59 and leveler 45 are cooled by the air flow therethrough.

Beneath the fuel leveler 45 and overlying the upper end of the outer drive shaft 57 and the sleeve bushing 93, a rotative throat plate 94 is fixed to the inner drive shaft 59 by a set screw 96 at a level corresponding to the inwardly tapered chamber wall refractory enlargement 36. This throat plate 94 has a depending peripheral downwardly and outwardly deflected apron edge face 94' that opposes the annular tapered surface of the refractory enlargement 36 to provide a restrictive bottom throat area 43 of the gasifying chamber for the passage of the gas products and final burning of the fuel mass to ensure the full extraction of the gas products therefrom.

A set collar 97 is secured to the inner shaft 59 by a set screw 98 beneath the throat plate 94 to retain the sleeve bushing 93 in place against upward displacement from the upper end of the outer drive shaft 57 and the throat plate 94 and fuel mass leveler 45 against downward displacement in the gasifying chamber 31.

Just below the thrust bearing 58 that supports the outer drive shaft 57 upon the inner drive shaft 59, a chain sprocket 101 is secured to the inner drive shaft 59 by a set screw 102. A sprocket chain 103 laterally extends from this drive sprocket 101 to drive sprocket 104 of electric motor 105 to be driven thereby and, mounted in vertically-opposing relationship with the outer drive shaft motor 69 on the same gasifier support post 20. Thus, the inner drive shaft 59 and the devices connected thereto will be driven independently of the outer drive shaft 57 and its devices and thus can be independently operated and controlled.

An ash chamber hopper 106 of funnel shape is suspended from the bottom ash hearth plate 23. A rotary conveyor 107 is provided in the lower end of the hopper that is operable in response to ash build-up in the hopper 106. A level switch arm 108' extends from a switch box 108 mounted on the side of the hopper and over the ash build-up. As the level arm 108' is raised it closes the switch 108 that is connected by wiring with an electric motor in a suitable manner, not shown, so as to rotate the rotary conveyor 107 and discharge ash into a removable bottom pan 111 for final removal from the gasifier. This ash hopper 106 also carries a stuffing box 112 that accommodates the vertically-extending drive shafts 57 and 59. This stuffing box 112 is partly filled with stuffing box material 113 and air is let into the stuffing box from air holes 126 and 128 in the two concentric drive shafts 59 and 57 to blow off any ash tending to enter the stuffing box 112 and cool the ash in the pit hopper 106. The stuffing box material 113 prevents the cooling air from escaping with ash into the ambient area from along the outer drive shaft 59 that extends therethrough.

In operation, the belt conveyor 41 brings fresh fuel 116 of low rate of gasification, such as wood chips, garbage or trash, to open top of the rotary air lock feeder 38 on demand from the fuel level sensor 42 with its arm 42' extending over the fresh fuel mass in the gasifying chamber 31, the air lock rotary conveyor 44 of the funnel feeder 38 being driven concurrently therewith. Downdraft air is supplied from the fan 49 by way of air conduit 46 and its plenum portion 46' about the feeder 38 and holes 47 into the feeder below its rotary air lock conveyor 44 to enter with the fresh fuel into the gasifying chamber 31 and supply sufficient air to produce a continuous flow of the gaseous products therefrom. Once the gasification is initiated, heat energy will sustain the gasification reaction and the gas flow will continue indefinitely, so long as fuel and air are supplied to the gasification chamber 31 and the ash is removed therefrom.

The flow of air from the fan 49 and fuel 116 will sustain gas production. Additional downdraft air that is forced up the inner drive shaft 59 and leveler 45 places the gasifying chamber 31 under increased downdraft pressure; maintains the flow of gas products through the gasifier chamber 31, throat 43, cylindrical grate 75, annular space 117 to flanged outlet pipes 118 secured to the annular plate 22 by bolts 119. A demand temperature sensor 121 is provided on one of the outlet pipes 118 and will be suitably wired to the air fan sources 49 and 63 and fuel conveyor 41 to maintain the output of the gas products from the gasifier. Below the maximum allowed temperature of the output set point of the sensor controller 121, the demand output sensor controller 121 becomes effective to add fuel and air. The final gas products are directly delivered from the outlet pipes 118 for use to some gas burning furnace or turbine.

For best operation of the gasifier, a flat fresh fuel level of the fuel mass in the gasifying chamber 31 should be maintained in order to best provide the desired richness of the resultant gases. The rotary leveler 45 keeps a flat profile of the fresh fuel mass within the gasifying chamber 31. The elevation of the rotary leveler 45 may be varied by loosening set screws of the several parts fixed to the inner drive shaft 59 and adjusting the shaft 59 and leveler 45 up or down, as desired. This also will require a readjustment of the throat plate 44 on the shaft 59, ash cap plate 91, set collar 97, thrust bearings 58 and 69 and chain driven sprocket 101.

The air-cooled leveler 45 is made of the best heat resistant metal available and maintains the flat level profile of the fresh fuel supply. The leveler is rotated at a constant speed by the electric motor 105, drive chain 103 and inner shaft 59. While the leveler is rotated, air is delivered from the fan-operated device 63 upwardly through the inner drive shaft 59 and discharged downwardly and outwardly over the fresh fuel mass of the gasifying chamber 31 to increase the air pressure therein. As the leveler is continuously rotated, it drags over the fuel mass to maintain the flat level profile thereover at all times. Since the pressure of the air from the leveler 45 is greater than the main downdraft air flow from fan 49, adequate pressure is ensured in the pressure gasification chamber to discharge the gas products through the outlet pipes 118 from the gasifier.

As required of a downdraft gasifier, an annular restricted throat zone 43 has been provided by the tapering bottom enlargement 36 of the refractory lining 29 of the gasifying chamber 31 and the downwardly and outwardly deflecting apron edge 94' of the rotating throat plate 94 by effecting opposing downwardly converging concentric surfaces. The generated gases from the gasifying chamber 31 are forced downwardly through an incandescent throat zone 43 and is deflected inwardly by the inwardly tapering refractory enlargement 36 away from the vertically-extending cylindrical grate 75 that depends from the annular plate 22. The rotating throat plate 94 promotes the flow of fresh fuel, ash and slag through the bottom throat zone 43. The flow of gas products pass through the throat zone 43 so as to finally convert condensate tars and other volatile matter into the resultant useful gaseous components. These gas products will have moved downwardly thence laterally from off the top of the ash chamber 26 through the vertically-extending cylindrical grate 75 instead of downwardly through an ash chamber as in the case of the conventional type gasifier.

To effectively carry out this lateral removal of gas products, there has been provided this vertically-extending cylindrical grate 75 and upper and lower grate clearing assemblies 71 and 72 loosely splined to the outer vertically-extending drive shaft 57 to keep the vertical grate cleared. Each assembly is supported by the tip ends of its three helically-shaped blades resting respectively upon three vertically-spaced circular grate bars 75' to clear these bars of clinkers and ash and to free the escape of the generated gas products therethrough to the annular area 117 at the top of the ash chamber 126 and to the outlet pipes 118. The arrangement for obtaining the lateral removal of clinker and ash free gas products has been one of the principal features of the invention.

In a conventional downdraft gasifier the gas products would be forced downwardly through a bottom funnel-shaped construction and through a horizontal flat grate ash hearth. Thus, conventional downdraft gasifiers are limited to low burning temperatures and low ash fuels to keep down slag formation that tend to plug grate openings. With the cylindrical grate 75 of the present gasifier, the clinkers can fall down free of this cylindrical grate and such free clinkers that enter the grate will be easily cleared by the grate clearing assemblies 71 and 72. The gas products are thus removed laterally from their normally downward path and at a level well removed from the ash collection upon the bottom hearth 33.

Slag forms at will in the gasifying chamber 31 in the bottom throat zone 43 thereof and flows downwardly into the ash collection chamber 26 and in a condensate state will adhere to grate bars and form clinkers thereon that have to be freed of the grate bars. The clinkers are generally forced downwardly with the ash but such clinkers that form on the cylindrical grate bars will be freed by the clearing blades 74 of the clearing assemblies 71 and 72. These grate clearing assemblies 71 and 72 supported as they are from three points on the grate bars and loosely connected to the splined drive shaft, can tilt or rock to adjust to the clinkers on the grate bars for best removal of them and may even ride over such clinkers that may prevail and prevent breakage of the blades.

The rotary ash rejection plate 54 is cut away to provide radially-extending, helical-like clearing edges 54'' and is similarly loosely connected to the splined outer drive shaft 57 to tilt and wobble when encountering clinkers as the ash is being swept from the bottom hearth plate 23 into its central spider arm opening 23'. The rejection plate 54 will adjust to clinker obstructions and even ride over the severe obstructions to prevent breakage of the drive parts. The ash moves down the ash chamber 26 onto its rotary cap plate 91 that caps the spider arm bottom plate opening 23' and from it onto the fixed bottom hearth plate 23 for its final discharge into the ash pit 106 by the rotary ash rejection plate 54.

Such smaller ash particles that pass through the cylindrical grate 75 will build up in annular space 117 outside of the grate and below the annular plate 22 as the gas products are taken off through upstanding outlet pipes 118. When the ash level within this annular space becomes too high, ash level controller 124 and its arm 124' in the annular space 117 overlying the ash therein will start motor 69 to drive outer shaft 57, the cylindrical grate clearing assemblies 71 and 72 and rotary hearth rejection plate 54. Ash will be discharged through the hearth plate opening 23' into the ash hopper 106 where ash builds up to lift arm 108' of level controller 108 to operate the motor that drives rotary conveyor 107 in the narrowed bottom end of the hopper 106 to deliver the final ash into pan 111 by which ash is finally taken from the gasifier.

The outer drive shaft 57 is cooled by air from small escape holes 126, 128 and upper hole 127 at two levels of the inner drive shaft 59 and escapes into the stuffing of box 112 of ash hopper through air escape through the shaft holes 126, 128. Cooling air will also pass upwardly through the outer shaft 57 and through upper sleeve bushing 93 in the upper of outer drive shaft into ash collection chamber 26 just below throat zone 43 on chamber 31 to keep the drive shaft free of ash.

When the ash level in the annular space 117 becomes too high, the ash level controller 124 and its arm 124' which operates in same manner as ash controller 108 previous described operates drive motor 69 which clears the ash from the annular space 117 and ash chamber 26 by using rejection plate 54 and at the same time any clinkers plugging the cylindrical grate 75 are cleared by the ends of blades 74 of the grate clearing assemblies 71 and 72. Thus, the removal of clinker ash throughout the entire gasifier is done automatically by positive mechanical means and not wholly dependent upon gravity.

While various changes may be made in the detail construction it shall be understood that such changes will be within the spirit and scope of the present invention as defined by the appended claims.

What is claimed is:

1. A pressurized downdraft gasifier for extracting high quality gas products from solid carbonaceous fuels having low rates of gasification comprising; gasifying chamber means with a lower burning zone therein, gas lock means connected to the gasifying chamber means for supplying fuel and downdraft combustion air to the gasifying chamber means, ash collection chamber means connected to the gasifying chamber means to receive ash emanating from the burning zone through a throated zone in the bottom of the gasifying chamber means, a cylindrical grate bar assembly concentrically depending from the gasifying chamber means below the throated zone and extending downwardly into the ash collection chamber means, said cylindrical grate bar assembly including circular grate bars vertically-spaced from one another, said ash collection chamber means providing an annular space about the grate bar assembly for receiving gas products passing laterally from beneath the throated zone and through the grate bar assembly, outlet means communicating with the annular space for removing the gas products from the gasifier, rotary drive shaft means extending vertically into the ash collection chamber means and a grate bar clearing assembly connected to the rotary drive shaft means to be driven thereby and having grate clearing blades extending laterally between the circular grate bars to stir ash in the ash collection chamber means and to free the grate bars of clinkers that may be deposited between them.

2. A pressurized downdraft gasifier for extracting high quality gas products from fuels having low rates of gasification as defined in claim 1 wherein the circular grate bars are hollow and provide passageways for cooling water therethrough.

3. A pressurized downdraft gasifier for extracting high quality gas products from fuels having low rates of gasification as defined in claim 1 wherein said vertically-extending drive shaft is splined, said grate bar clearing assembly having an oversized notched plate for loosely receiving the splined drive shaft to allow tilting of the grate bar clearing assembly upon the splined vertical drive shaft as it is rotated, said grate bar clearing assembly having three blades angularly staggered and located at three elevations for their blade ends to respectively rest upon different vertically-spaced grate bars for the support of the assembly upon the vertically-extending drive shaft, whereby the grate bar clearing assembly may tilt or rock to adjust to clinker obstructions between the grate bars.

4. A pressurized downdraft gasifier for extracting high quality gas products from fuels having low rates of gasification as defined in claim 1 wherein said ash collection chamber means includes a bottom hearth plate with a central opening therein and a rotary ash rejection plate connected to and driven by said rotary drive shaft means for sweeping ash from the bottom hearth plate into the central opening.

5. A pressurized downdraft gasifier for extracting high quality gas products from fuels having low rates of gasification as defined in claim 4 including a cap plate overlying the bottom hearth central opening and ash rejection plate and connected to the rotary drive shaft means to be driven by the same.

6. A pressurized downdraft gasifier for extracting high quality gas products from fuels having low rates of gasification as defined in claim 4 wherein said rotary drive shaft means in hollow and an inner drive shaft extends upwardly therethrough and into the gasifying chamber means, a fuel mass leveler connected to an upper end of the inner drive shaft to be rotated thereby and means for driving the inner drive shaft independently of the outer rotary drive shaft.

7. A pressurized downdraft gasifier for extracting high quality gas products from fuels having low rates of gasification as defined in claim 6 wherein said inner drive shaft and fuel mass leveler are hollow and a fan means is provided for directing air at a pressure greater than that of the downdraft air through the hollow inner drive shaft and into the hollow leveler to cool these parts and to deliver additional air under pressure to the gasifying chamber means through openings in the hollow leveler to ensure the passage of the gas products from the gasifying chamber means into the annular space.

8. A pressurized downdraft gasifier for extracting high quality gas products from fuels having low rates of gasification as defined in claim 4 including ash hopper means depending downwardly from the bottom hearth plate to receive ash swept into the central opening, said outer drive shaft extending upwardly through a stuffing box on the ash hopper means, said fan means delivering air under pressure through openings in the hollow inner drive shaft and in the hollow outer drive shaft to prevent ash from entering the stuffing box along the outer drive shaft extending therethrough.

9. A pressurized downdraft gasifier for extracting high quality gas products from fuels having low rates of gasification as defined in claim 6 including a throat plate connected to the inner drive shaft and lying in the bottom throated zone of the fuel gasifying chamber.

10. A pressurized downdraft gasifier for extracting high quality gas products from fuels having low rates of gasification as defined in claim 9, wherein said fuel gasifying chamber means is lined with refractory material providing an inwardly tapered enlargement forming an outer part of the throated zone overlying the cylindrical grate bar assembly to deflect ash inwardly therefrom and said rotary throat plate forming an inner part of the throated zone and having a downwardly and outwardly deflected apron edge opposing the inwardly tapered refractory enlargement.

11. A pressurized downdraft gasifier for extracting high quality gas products from fuels having low rates of gasification as defined in claim 4 wherein said rotary drive shaft is splined at the level of the rotary ash rejection plate, said ash rejection plate having an oversized notch for receiving the splined drive shaft to allow tilting of the ash rejection plate as it is rotated by the rotary drive shaft, whereby the ash rejection plate may adjust to clinker obstructions overlying the bottom hearth plate.

* * * * *